United States Patent [19]

Demetrius

[11] Patent Number: 4,993,192

[45] Date of Patent: Feb. 19, 1991

[54] POWER SANDING DEVICE

[76] Inventor: Kris D. Demetrius, 2843 State St., Apt. #4, Santa Barbara, Calif. 93105

[21] Appl. No.: 440,802

[22] Filed: Nov. 24, 1989

[51] Int. Cl.[5] ..... B24B 23/00

[52] U.S. Cl. ..... 51/170 PT; 51/375; 51/181 R; 15/111

[58] Field of Search ..... 51/170 PT, 170 R, 364, 51/372, 375, 181 R; 15/23, 49.1, 52.2, 50.1, 50.3, 52, 82, 93.1, 111, 105, 106, 236.1

[56] References Cited

U.S. PATENT DOCUMENTS

| | | | |
|---|---|---|---|
| 1,011,490 | 12/1911 | Rasmesen | 51/170 PT |
| 1,087,068 | 2/1914 | Lueck | 51/170 R |
| 2,069,700 | 2/1937 | Emmons | 51/170 PT |
| 2,120,252 | 6/1938 | Kadri | 51/170 PT |
| 2,259,475 | 10/1941 | Koether | 51/364 |
| 2,800,750 | 7/1957 | Field | 51/375 |
| 2,853,838 | 9/1958 | Richards | 51/170 PT |
| 2,925,644 | 2/1960 | Barggren | 51/170 PT |
| 3,468,073 | 9/1969 | Vecchio | 51/375 |
| 4,671,019 | 6/1987 | Hutchins | 51/170 MT |
| 4,805,349 | 2/1989 | Demetrius et al. | 51/170 PT |

FOREIGN PATENT DOCUMENTS

| | | | |
|---|---|---|---|
| 626119 | 5/1927 | France | 51/170 PT |
| 80413 | 3/1963 | France | 51/170 PT |
| 1273534 | 5/1972 | United Kingdom | 51/170 PT |

*Primary Examiner*—Roscoe V. Parker
*Attorney, Agent, or Firm*—Robert M. Sperry

[57] ABSTRACT

Improved power-driven abrading devices comprising a motor, a housing enclosing said motor, a drive shaft extending parallel to and below the axis of said housing, means coupling said motor to drive said drive shaft, a resilient drum releasably mountable about said drive shaft for rotation with said drive shaft and abrading means releasably mountable on said drum.

19 Claims, 4 Drawing Sheets

POWER SANDING DEVICE

BACKGROUND

1. Field of the Invention

This invention relates to abrasive devices and is particularly directed to power operated sanding and scraping devices.

2. Prior Art

One of the most tiresome and time-consuming activities in woodworking is that of sanding or scraping operations which are necessary to provide a smooth finished surface or to remove previous coats of paint, varnish and the like in preparation for application of a new protective or decorative surface. Numerous types of power-driven devices have been proposed heretofore for accomplishing these tasks. However, many of the prior art power sanding devices have been heavy and bulky devices which were difficult to handle and manipulate even using two hands. Other prior art power sanding devices have been limited to sanding operations and could not be adapted to perform scraping operations, while those prior art devices which have been intended for scraping have not been adaptable for performing sanding operations. A search in the United States Patent Office has revealed the following patents:

| U.S. PAT. NO. | INVENTOR | ISSUED |
|---|---|---|
| 1,011,490 | G. Rasmesen, Jr. | Dec. 12, 1911 |
| 1,087,068 | F. O. Lueck | Feb. 10, 1914 |
| 4,805,349 | K. Demetrius et al | Feb. 21, 1989 |

Although the power sanding device of my previous patent, U.S. Pat. No. 4,805,349, has considerable merit, I have found that substantial improvements could still be made. Thus, none of the prior art power sanding devices have been entirely satisfactory.

BRIEF SUMMARY AND OBJECTS OF THE INVENTION

These disadvantages of the prior art are overcome with the present invention and improved power sanding and scraping devices are proposed which are considerably lighter and more compact than those of the prior art and which can easily and conveniently be controlled and manipulated with one hand. Moreover, the device of the present invention may quickly and easily be converted from sanding to scraping operations and vice versa.

The advantages of the present invention are preferably attained by providing a power-driven sanding and scraping device comprising a motor, a housing enclosing said motor, a drive shaft supported at only one end and extending parallel to and below the axis of said housing, means coupling said motor to drive said drive shaft, a resilient drum releasably mountable about said drive shaft for rotation with said drive shaft and abrading means releasably mountable on said drum.

Accordingly, it is an object of the present invention to provide improved power-driven abrading devices.

Another object of the present invention is to provide improved power-driven sanding and scraping devices.

A further object of the present invention is to provide improved power-driven abrading devices which are light and compact in structure and which can easily be controlled and manipulated with one hand.

An additional object of the present invention is to provide improved power-driven abrading devices which can quickly and easily be converted from sanding operations to scraping operations and vice versa.

A specific object of the present invention is to provide improved power-driven abrading devices comprising a motor, a housing enclosing said motor, a drive shaft extending parallel to and below the axis of said housing, means coupling said motor to drive said drive shaft, a resilient drum releasably mountable about said drive shaft for rotation with said drive shaft and abrading means releasably mountable on said drum.

These and other objects and features of the present invention will be apparent from the following detailed description, taken with reference to the figures of the accompanying drawings.

DETAILED DESCRIPTION OF THE INVENTION

Figure 1:
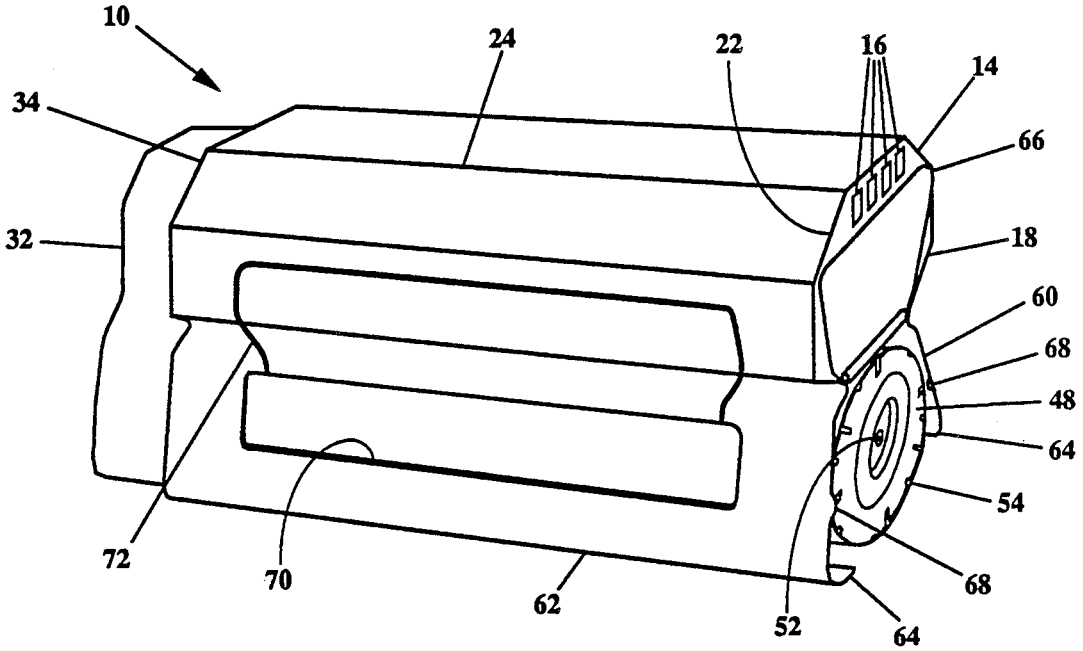
FIG. 1 is an isometric view of an abrading device embodying the present invention.
Figure 2:
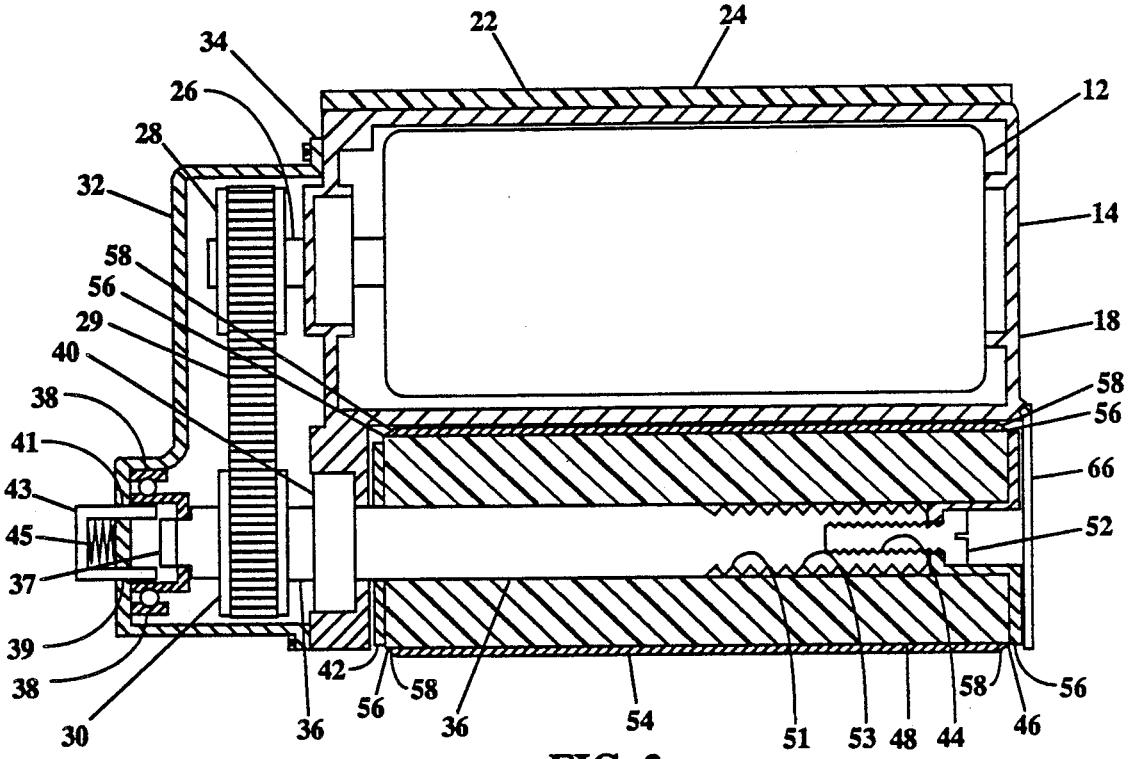
FIG. 2 is a vertical section through the abrading device of FIG. 1.

In that form of the present invention chosen for purposes of illustration in the drawing, FIG. 1 shows an abrading device, indicated generally at 10. As best seen in FIGS. 1 and 2, the abrading device 10 comprises a motor 12 mounted within an elongated housing 14 of generally circular cross-section having a plurality of air holes 16 formed in one end 18 of the housing 14. Preferably, the outer surface 20 of the housing is covered with a layer 22 of resilient material, such as rubber, formed with a generally octagonal exterior surface 24. This facilitates gripping of the abrading device 10 and serves to minimize the amount of vibration transferred from the abrading device 10 to the user's hand.

As best seen in FIG. 2, the motor 12 serves to rotate a drive shaft 26 which rotates a pulley 28 which drives a cogged belt 29 and, hence, drives pulley 30 contained within a cover 32 mounted on end 34 of the housing 14. Pulley 30 is mounted on a shaft 36 which is supported by suitable bearings 38 and 40 and which extends parallel to and below the axis of the motor 12. If desired, gearing may be employed to couple the motor 12 to rotate the drive shaft 36. The shaft 36 is formed with a rectangular end portion 37 which is mounted in the bearing 38, as seen in FIG. 2, and the cover 32 is provided with a pair of slots 39 and 41 adjacent the end 37 of the shaft 36. A generally U-shaped lock member 43 is mounted to slideably project through the slots 39 and 41 to engage end 37 of the shaft 36 and is normally urged inwardly by suitable resilient means, such as spring 45, to engage end portion 37 of the shaft 36 to prevent the shaft 36 from turning while the drum 48 and screw 52 are installed. This frees both of the user's hands for use in installing the drum or for other purposes. When not in use, the lock member 43 may be pulled outwardly against the action of the spring 45 and rotated to a position out of alignment with the slots 39 and 41 to lock the U-shaped member 43 out of action and to permit free rotation of the shaft 36.

In addition, the shaft 36 is provided with a flange 42 adjacent the bearing 40 and has a threaded recess 44 extending axially inward from the free end 46 of the shaft 36. A drum 48, formed of resilient material, such as rubber, is slideably mounted on the shaft 36 and is retained by a flanged washer 50 and a screw 52 which mates with the recess 44 of the shaft 36. Also, the drum 48 has an internally threaded portion 51 which mates with a correspondingly threaded portion 53 of the shaft 36 to facilitate installation of the drum 48 on the shaft 36. Suitable abrading means, such as sleeve 54 are mounted on the drum 48 and are retained thereon due to expansion of the resilient drum 48 caused by compression of the drum 48 between flange 42 of the shaft 36 and flanged washer 50 when the screw 52 is threaded into the recess 44 of the shaft 36. The abrading sleeve 54 may be formed a cylindrical member of sandpaper or, if desired, may be a thin sleeve of metal having a plurality of abrading points formed thereon somewhat in the manner of a kitchen grater. Preferably, however, the abrading element 54 will be of the form described below with respect to FIG. 3. With many prior art power-driven abrading devices the edges of the abrading material are sharp and create lines when the abrading device is operated in an adjacent area overlapping a previously abraded area. To prevent this, the ends 56 of the abrading sleeve 54 are preferably bevelled, as seen at 58 in FIG. 2, which prevents sharp edges to the abraded area and, hence, permits overlapping operation without creating unwanted lines.

As best seen in FIGS. 1 and 2, the housing 14 is formed with a pair of skirts 60 and 62 extending downwardly from each side of the housing 14 on either side of the shaft 36 and spaced a sufficient distance from the shaft 36 to permit free movement of the resilient drum 48 and abrading sleeve 54. The skirts 60 and 62 are provided with inwardly-curved lower edges 64 which serve to support the abrading device 10 when not in use and the skirts 60 and 62 are of sufficient length that the lower edges 64 are approximately level with the surface of the abrading sleeve 54 when it is mounted on the resilient drum 48 and shaft 36. Thus, in use, the abrading device 10 may be rocked onto one or the other of skirts 60 or 62 to permit very fine control of the depth of the action of the abrading sleeve 54. A door 66 is hingedly secured to the lower edge of end 18 of the housing 14 and is movable between an open position, as seen in FIG. 1, and a closed position, as seen in FIG. 2. In the open position, the door 66 permits access to the end of the shaft 36 to facilitate mounting and dismounting of the resilient drum 48 and abrading sleeve 54. In the closed position, the door 66 serves to contain dust created during an abrading operation and is releasably retained in the closed position by suitable means, such as spring clips 68. To further contain the dust created during operation of the abrading device 10, a hole 70 may be provided in skirt 62, and a wire frame 72 may be mounted adjacent the hole 70 to support a suitable dust bag, not shown. When the abrading device 10 is operated, rotation of the drum 48 and abrading sleeve 54 will create a breeze which will tend to carry the dust created by the abrading operation through hole 70 into the dust bag supported by the wire frame 72, while skirts 60 and 62 and door 66 serve to prevent the dust from escaping randomly.

Figure 4:
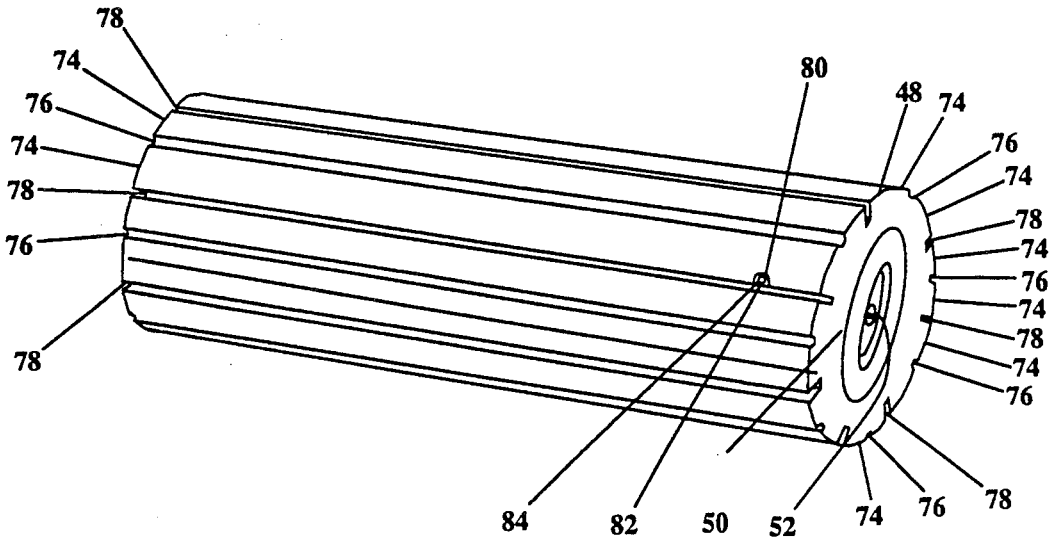
FIG. 4 is an isometric view of the resilient drum of the abrading device of FIG. 1.
Figure 3:
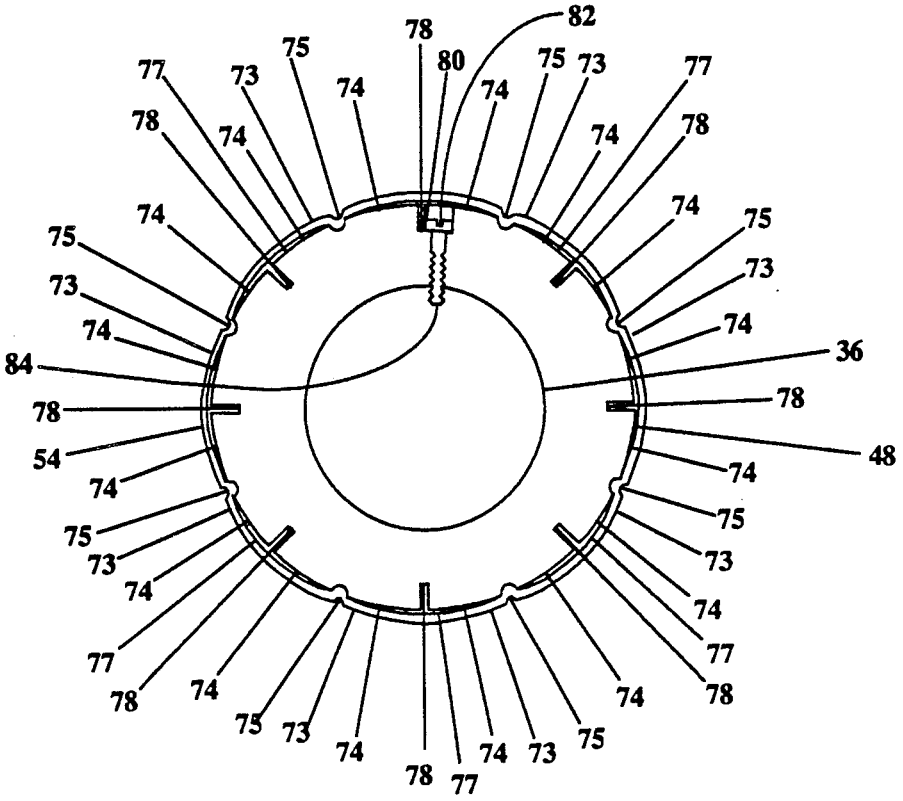
FIG. 3 is an end view of the shaft, the drum and the abrading sleeve of the brading device of FIG. 1.

As best seen in FIGS. 3 and 4, the resilient drum 48 is formed with a plurality of alternate ridges 74 and recesses 76 extending lengthwise of the drum 48 and each of the ridges 74 is provided with a longitudinal slit 78 and one of the slits 78 has a recess 80 extending from one side thereof to receive an alignment pin 82. The alignment pin 82 projects into a hole 84 in the shaft 36 and serves to maintain the resilient drum 48 is proper orientation with respect to the shaft 36. If desired, the hole 84 may be threaded and alignment pin 82 may be correspondingly threaded to assure retention of the pin 82 during operation of the abrading device 10. The abrading sleeve 54 is also formed with a plurality of alternate ridges 73 and recesses 75, as best seen in FIG. 3. It should be noted that the recesses 75 of the abrading sleeve 54 engage the recesses 76 of the resilient drum 48 and serve to support the abrading sleeve 54 on the drum 48. In contrast, the ridges 73 of the abrading sleeve 54 are slightly higher than the ridges 74 of the resilient drum 48 so that a slight space 77 is provided between the ridges 73 of the abrading sleeve 54 and the surface of the ridges 74 of the drum 48. The space 77 serves to cool the abrading sleeve 54 and prevents the abrading sleeve 54 from becoming overheated and tending to melt the pain and become clogged. Also, the space 77 provides a passage which permits sanding dust to migrate to the ends of the abrading sleeve 54 and, hence, to be picked up by the wind of motion and carried out through opening 70 into the dustbag, not shown. The alternate ridges and recesses serve to facilitate driving of the abrading sleeve 54 and facilitates removal of the dust created during the sanding operation.

Figure 5:
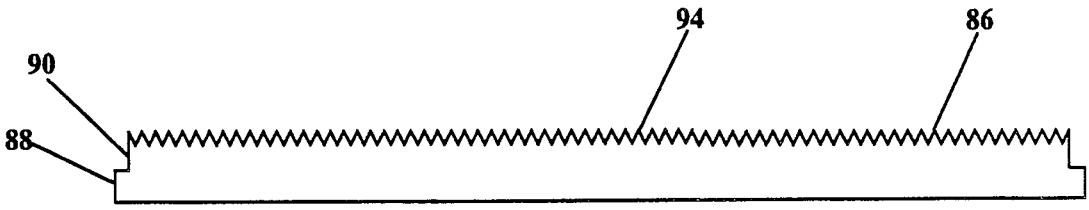
FIG. 5 is a side view of a scraping blade for use with the abrading device of FIG. 1.
Figure 6:
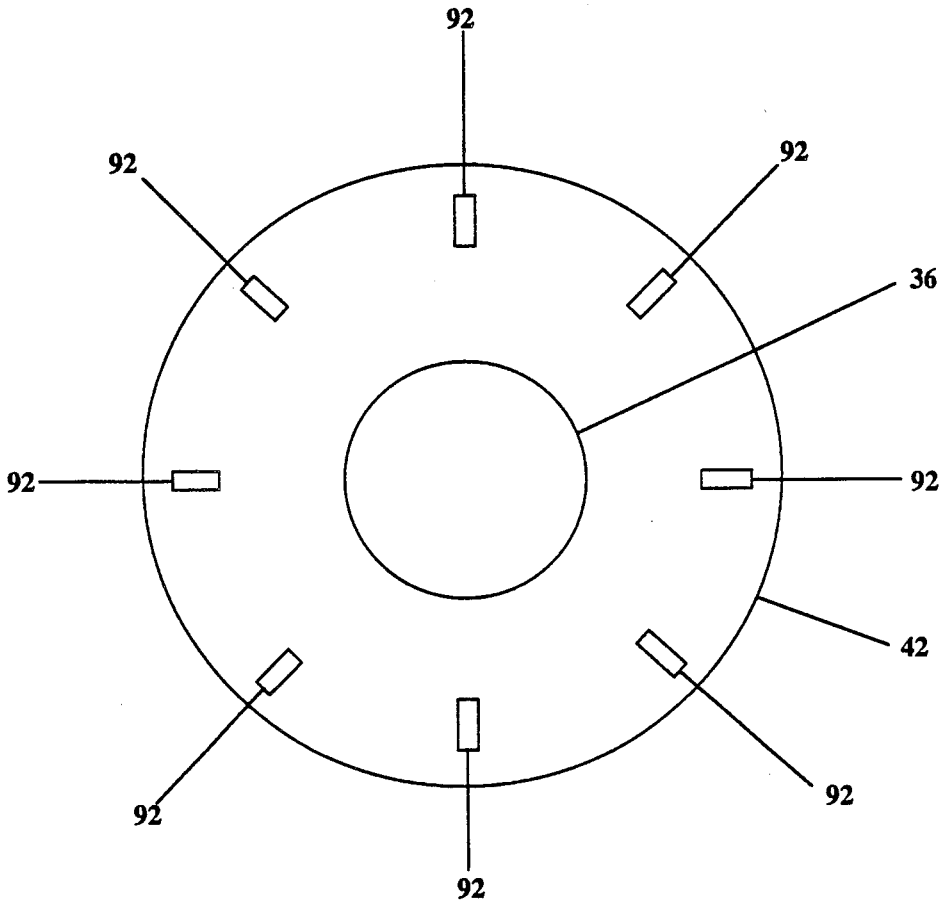
FIG. 6 is an end view of the inner flange of the shaft of the abrading device of FIG. 1.

For sanding operations, the door 66 is opened, screw 50 is loosened and an abrading sleeve 54, formed of sandpaper, thin metal or other suitable material is slid onto the resilient drum 48. Next, the screw 50 is tightened causing the resilient drum 48 to be compressed between flange 42 of shaft 36 and the flanged washer 50. This causes the resilient drum 48 to expand and serves to securely lock the abrading sleeve 54 on the drum 48. Thereafter, the motor 12 is started and acts through drive shaft 26 and gears 28 and 30 to rotate the shaft 36, drum 48 and abrading sleeve 54. As the abrading device 10 is operated, dust created by the sanding operation gathers in the recesses and is removed from the work area by the leading edge of the adjacent one of the ridges. Furthermore, the rotation of the drum 48 and abrading sleeve 54 serves to create a breeze which carries the dust through hole 70 into the dust bag supported by wire frame 72 for convenient removal and disposal when desired.

Where scraping operations are to be performed, the abrading sleeve 54 is removed and is replaced by a plurality of scraping blades, such as that shown at 86 in FIG. 5. As shown, the scraping blades 86 are thin, elongated sheets of relatively rigid material, such as metal or the like, and are provided with a mounting tongue 88 projecting from one end 90 of the blade 86. As seen in FIG. 6, the flange 42 of shaft 36 is provided with a plurality of radially extending slots 92 and the scraping blades 86 are mounted by sliding each of the scraping blades 86 into a respective one of the slits 78 formed in the ridges 74 of the resilient drum 48 until the mounting tongue 88 of the scraping blade 86 projects through an appropriate one of the slots 92 in the flange 42 and the end 90 seats against the flange 42. Alignment pin 82 serves to assure that each of the slits 78 is properly aligned with a corresponding one of the slots 92 of flange 42 to ensure proper mounting of the scraping blades 86. The scraping blades 86 are dimensioned so that edge 94 of the scraping blades 86 will project above the adjacent ridge 74 of the resilient drum 48 and, if desired, edge 94 may be serrated or toothed, as seen in FIG. 5 to facilitate the scraping operation.

Figure 7:
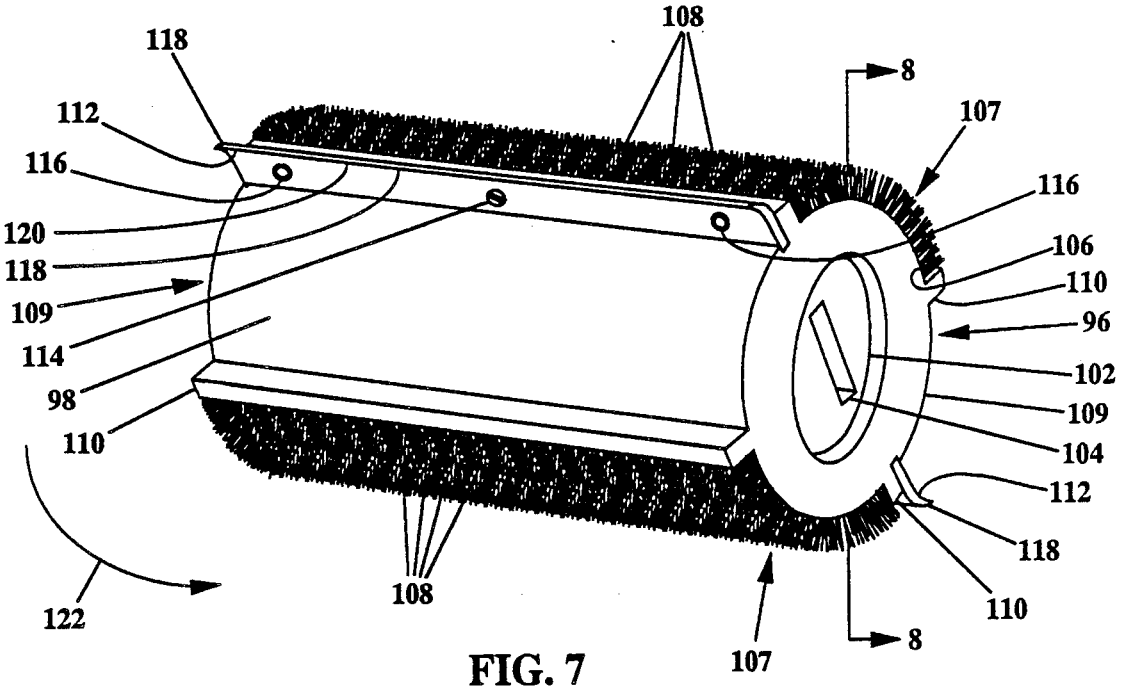
FIG. 7 is an isometric view of a wire brush member for use with the abrading device of FIG. 1.
Figure 8:
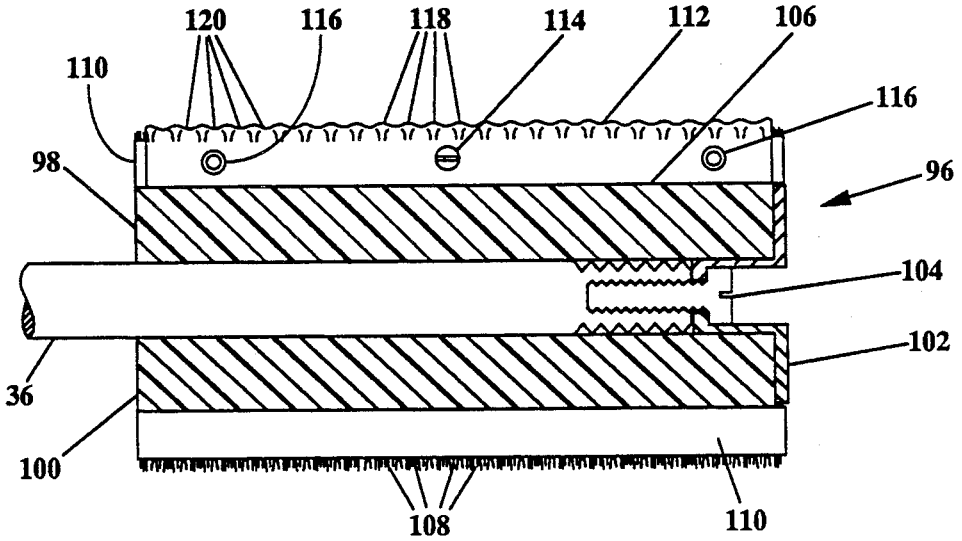
FIG. 8 is a vertical section through the wire brush member of FIG. 7.

In some instances, an abrading action may be desired which is intermediate that of the sanding sleeve 54 of FIG. 3 and that of the blades 86 of FIG. 5. For these instances, the wire brush member, indicated generally at 96 in FIGS. 7 and 8 may be employed. The wire brush 96 is installed by removing the sanding sleeve 54 and threading the wire brush member 96 onto the drive shaft 36 of the abrading device 10. As best seen in FIG. 8, the wire brush member 96 comprises a cylindrical sleeve 98 having one end 100 open to slidably receive the drive shaft 36, while the other end 102 may be open or may be closed, as seen in FIGS. 7 and 8 and formed with a slot 104 to allow insertion of a screw driver for tightening or loosening the sleeve 98 with respect to the drive shaft 36. The outer surface 106 of the wire brush member 96 is formed with a plurality of segments 107 having wire bristles 108 projecting outwardly therefrom and separated by a plurality of segments 109 having no bristles 108. The segments 107 and 109 are separated by a plurality of ridges 110 which extend lengthwise of the sleeve 98 and projecting outward from the surface 106 a distance slightly less than that of the wire bristles 108. Those of the ridges 110 which preceed the bristle segments 107 during, rotation, each carry a scraping blade 112 secured by suitable means, such as screws 114, and held in proper alignment by suitable means, such as studs 116. The outer edges 118 of the scraping blades 112 are curved forewardly and are formed with a plurality of grooves 120 extending perpendicular to the outer edge 118 which cooperate to form a plurality of teeth or serrations along the outer edges 118 of the scraping blades 112 to enhance the scraping action of the blades 112.

When the wire brush member 96 is used, rotation of the drive shaft 36 serves to rotate the wire brush member 96 in the direction indicated by arrow 122 in FIG. 7. Since the outer edges 118 of the scraping blades 112 are curved in this direction, the serrations formed by grooves 120 will serve as teeth to scrape the surface being treated. Immediately thereafter, the wire bristles will follow to abrade the treated surface more finely. This will be followed by a non-bristled segment 109 which allows dust and debris from the abrading action to be removed before the next scraping blade 112 begins its scraping action.

Obviously, numerous other variations and modifications can be made without departing from the spirit of the present invention. Therefore, it should be clearly understood that the forms of the present invention described above and shown in the figures of the accompanying drawings are illustrative only and are not intended to limit the scope of the present invention.

What is claimed is:

1. (The device of Claim 3 further) A power-driven abrading device comprising:

a motor, a housing enclosing said motor, a drive shaft extending parallel to and below the axis of said housing, means coupling said motor to drive said drive shaft, a drum releaseably mountable about said drive shaft for rotation with said drive shaft, said drum being formed of resilient material and having a plurality of alternate ridges and recesses disposed about the periphery of said drum extending lengthwise of said drum and having a slit extending lengthwise along each of said ridges, (a flange projecting radially outward from said shaft adjacent the mounting end of said shaft and having a plurality of radial slots formed in said flange,) and (a plurality of acraping blades each releasably mountable in a respective one of said slits and having tongue means engageable with said slots of said flange to retain said blades in position during operation)

abrading means releasably mountable on said drum.

2. The device of claim 1 further comprising:

a layer of resilient material covering said housing.

3. The device of claim 1 wherein:

said abrading means is a sleeve corresponding to the shape of said drum and slidable onto and off of said drum.

4. The device of claim 1 further comprising:

a flange projecting radially outward from said shaft adjacent the mounting end of said shaft, a screw matable with a recess formed in the free end of said shaft, and a flanged washer releasably securable to the free end of said shaft by said screw and serving to compress said resilient drum between said washer and the flange of said shaft when said screw is tightened to cause said drum to expand to secure said abrading means on said drum.

5. The device of claim 1 further comprising:

a pair of skirts extending downwardly from said housing on either side of said shaft and each formed with an inwardly turned lower edge at a position level with the lower edge of said drum.

6. The device of claim 5 further comprising:

a hole formed in one of said skirts, and means mounted adjacent said hole to support a dust bag.

7. The device of claim 1 further comprising:

alignment means releasably securing said drum in a desired orientation with respect to said shaft.

8. The device of claim 5 further comprising:

a door hingedly secured to the lower edge of said housing and movable into and out of a position engaging the ends of said skirts, and resilient latching means for releasably locking said door in engagement with said skirts.

9. The device of claim 1 wherein:

said motor rotates a shaft which rotates a first pulley, a second pulley mounted adjacent one end of said drive shaft, belt means coupling said pulleys to rotate said shaft, and a pair of bearings each located on a respective side of said second pulley to support said shaft.

10. The device of claim 1 wherein:

said drum and said drive shaft are provided with mating threads to facilitate installation of said drum.

11. The device of claim 1 wherein:

said abrasive means is a sleeve having a plurality of alternate ridges and recesses, the recesses of said abrading sleeve engage the recesses of said drum and serve to support said sleeve on said drum while the ridges of said sleeve extend above the ridges of said drum to provide a space between said sleeve and said drum.

12. The device of claim 1 wherein:

said abrading device comprises:

a sleeve mountable on said drive shaft and having a plurality of wire bristles projecting outward from the surface of said sleeve.

13. The device of claim 12 further comprising:

said bristles being located in segments of the surface of said sleeve and having non-bristled segments interposed between the bristled segments.

14. The device of claim 13 further comprising:

a plurality of ridges extending lengthwise of said sleeve and projecting outward from the surface of said sleeve a distance slightly less than that of said wire bristles, a scraping blade secured to the leading side of at least one of said ridges.

15. The device of claim 14 further comprising:

said scraping blade being formed with the outer edge thereof curved forewardly and provided with a plurality of grooves extending perpendicular to said outer edge, said grooves cooperating to form a plurality of teeth along said outer edge of said scraping blade.

16. The device of claim 12 further comprising:

said sleeve having one end thereof open to receive said drive shaft and having an opening formed in the other end of said sleeve to allow insertion therethrough of a screw driver for tightening and loosening said drum.

17. The device of claim 1 further comprising:

a flange projecting radially outward from said shaft adjacent the mounting end of said shaft and having a plurality of radial slots formed in said flange, and a plurality of scraping blades each releasably mountable in a respective one of said slits and having tongue means engageable with said slots of said flange to retain said blades in position during operation.

18. A power-drived abrading device comprising:

a motor, a housing enclosing said motor, a drive shaft extending parallel to and below the axis of said housing, means coupling said motor to drive said drive shaft, and a sleeve mountable on said drive shaft and having a plurality of wire bristles projecting outward from the surface of said sleeve, said bristles being located in segments of the surface of said sleeve and having non-bristled segments interposed between the bristled segments, a plurality or ridges extending lengthwise of said sleeve and projecting outward from the surface of said sleeve a distance less than that of said wire bristles, and a scraping blade secured to the leading side of at least one of said ridges.

19. The device of claim 18 further comprising:

said scraping blade being formed with the outer edge thereof curved forewardly and provided with a plurality of grooves extending perpendicular to said outer edge, said grooves cooperating to form a plurality of teeth along said outer edge of said scraping blade.

* * * * *